US007802343B2

(12) United States Patent
Grey

(10) Patent No.: US 7,802,343 B2
(45) Date of Patent: Sep. 28, 2010

(54) SUCTION HEAD FOR A VACUUM CLEANER

(75) Inventor: Nicholas Gerald Grey, Crowle (GB)

(73) Assignee: Grey Technology Limited (GB)

( * ) Notice: Subject to any disclaimer, the term of this patent is extended or adjusted under 35 U.S.C. 154(b) by 0 days.

(21) Appl. No.: 11/503,443

(22) Filed: Aug. 11, 2006

(65) Prior Publication Data

US 2007/0163076 A1 Jul. 19, 2007

(30) Foreign Application Priority Data

Jan. 19, 2006 (GB) ..... 0601047.4

(51) Int. Cl.
*A47L 9/02* (2006.01)

(52) U.S. Cl. ..... 15/415.1

(58) Field of Classification Search ..... 15/415.1
See application file for complete search history.

(56) References Cited

U.S. PATENT DOCUMENTS

| | | | | |
|---|---|---|---|---|
| 1,968,974 | A * | 8/1934 | Tracy et al. | 15/356 |
| 2,235,226 | A | 3/1941 | Lofgren et al. | |
| 2,610,351 | A | 9/1952 | Lilly | |
| 5,347,679 | A | 9/1994 | Saunders et al. | |
| 5,502,870 | A | 4/1996 | Ragner et al. | |
| 5,509,171 | A | 4/1996 | Zejda | |
| 5,699,586 | A * | 12/1997 | Melito et al. | 15/383 |
| 5,765,258 | A | 6/1998 | Melito et al. | |
| 6,536,076 | B2 * | 3/2003 | Scian et al. | 15/415.1 |
| 6,584,640 | B2 * | 7/2003 | Vanderlinden | 15/418 |
| 6,588,058 | B2 * | 7/2003 | Vanderlinden | 15/416 |
| 6,772,477 | B2 * | 8/2004 | Murphy et al. | 15/415.1 |
| 2004/0025289 | A1 * | 2/2004 | Virgili et al. | 15/415.1 |
| 2005/0086764 | A1 * | 4/2005 | Lim et al. | 15/415.1 |
| 2006/0213026 | A1 * | 9/2006 | Lijzenga et al. | 15/368 |

FOREIGN PATENT DOCUMENTS

| | | | |
|---|---|---|---|
| EP | 1488726 | | 12/2004 |
| GB | 379436 | | 9/1932 |
| GB | 2224195 | A * | 5/1990 |
| WO | WO 2004056252 | A1 * | 7/2004 |

OTHER PUBLICATIONS

European Search Report Apr. 26, 2007.
International Search Report Feb. 24, 2006.

* cited by examiner

*Primary Examiner*—David B Thomas
(74) *Attorney, Agent, or Firm*—Ira S. Dorman

(57) ABSTRACT

A suction head for a vacuum cleaner comprises a hollow body including a pair of arms (1, 3) which diverge from predetermined region of the body at an acute angle. Each arm is formed with a channel (14) for the passage of air. An outlet opening (5) is located in the region of the body from which the arms diverge for the passage of air to a vacuum cleaner. A first continuous ground-engaging barrier (21) extends along the region of an inner edge (19) of one of the arms (1). A second continuous ground-engaging barrier (21) extends along the region of an inner edge (19) of the other of the arms (3). A gap (23) is formed between the first and second barriers (21) for the passage of relatively large particles of debris into the suction head.

22 Claims, 3 Drawing Sheets

SUCTION HEAD FOR A VACUUM CLEANER

FIELD OF THE INVENTION

This invention relates to a suction head for a vacuum cleaner.

DESCRIPTION OF PRIOR ART

Suction heads for vacuum cleaners are conventionally rectangular in shape, having reasonable width with relatively shallow depth. A problem associated with such conventional suction heads is that they do not function well with larger particles of debris. Small particles of debris pass readily beneath the leading edge of the suction head, but larger particles do not. It is known to provide gaps, or castellations, along the length of the leading edge in order that larger particles of debris can pass through the gaps, but such gaps lead to a reduction in efficiency of the vacuum cleaner with the result that the cleaner does not pick up debris effectively, particularly relatively large and heavy particles of debris. It has proved to be especially difficult to balance the need for gaps in order to pick up large and heavy particles of debris with the need to keep the size of the gaps to a minimum in order to maintain the suction efficiency.

A further problem that arises with known suction heads for vacuum cleaners is that is that they become significantly less effective when a debris collection bag is almost full or a filter becomes blocked, thus reducing the airflow through the suction head. When the airflow is high, most suction heads will cope adequately with most debris except for the largest items, but as the airflow reduces conventional suction heads fail to pick up denser items of debris such as small stones and particles of debris within crevices in the surface being cleaned.

OBJECT OF THE INVENTION

It is therefore an object of the present invention to provide a vacuum head for a suction cleaner which overcomes or at least ameliorates the above disadvantages.

SUMMARY OF THE INVENTION

According to the present invention there is provided a suction head for a vacuum cleaner, the suction head comprising:

a substantially hollow body including a pair of arms which diverge from a predetermined region of the body at an angle less than 180 degrees relative to each other, each arm defining therein a channel for the passage of air, which channel extends substantially from the free end of the arm to the region of the body from which the arms diverge;

an outlet opening located in the region of the body from which the arms diverge for the passage of air to a vacuum cleaner;

a first substantially continuous ground-engaging barrier extending along the region of an inner edge of one of the arms substantially from the free end of the arm to the region of the body from which the arms diverge; and a second substantially continuous ground-engaging barrier extending along the region of an inner edge of the other of the arms substantially from the free end of the arm to the region of the body from which the arms diverge, there being a gap between the first and second barriers in the region of the body from which the arms diverge for the passage of relatively large particles of debris into the suction head, the first and second barriers being adapted to engage a substantially flat ground surface along the entire length of the first and second barriers.

A substantially continuous further ground-engaging barrier may extend along the region of an outer edge of the arms substantially from the free end of one of the arms to the free end of the other of the arms.

Alternatively, a first substantially continuous further ground-engaging barrier may extend along the region of an outer edge of one of the arms substantially from the free end of the arm to the region of the body from which the arms diverge and a second substantially continuous further ground-engaging barrier may extend along the region of an outer edge of the other of the arms substantially from the free end of the arm to the region of the body from which the arms diverge, there being a further gap between the first and second further barriers in the region of the body from which the arms diverge for the passage of relatively large particles of debris into the suction head.

The channel formed in each of the arms may be open at the free end of each arm.

The arms may diverge in a V-shape or a U-shape.

The body may be provided with one or more wheels for supporting the body relative to the ground. One wheel may be provided each side of the outlet opening.

The suction head may include an outlet connection including a first tubular member secured to or formed integrally with the body and a second tubular member rotatable about the axis thereof relative to the first tubular member. The axis of the second tubular member may incorporate an angle along the length thereof. Such an arrangement facilitates steering of the suction head so as to guide large particles of debris towards the gap between the first and second barriers.

Rotatable means may be provided substantially at the free end of each arm for engaging with obstacles. The rotatable means may be in the form of a roller which is rotatable about a substantially upright axis.

The cross-sectional area of the channel may decrease towards the free end of each arm.

The barriers may be flexible, for example resilient. One or more of the barriers may comprise a plurality of stiff resilient bristles. Alternatively or additionally, one or more of the barriers may comprise a continuous strip. The continuous strip may be elastomeric, such as of rubber. The barrier or barriers in the region of the outer edge of the arms may comprise a plurality of stiff resilient bristles, while the barriers in the region of the inner edge of the arms may each comprise a continuous strip.

Thus the present invention provides a suction head for vacuum cleaners which works particularly effectively, for example on hard surfaces, even under conditions of reduced airflow such as often occur when a debris collection bag is almost full or a filter becomes blocked, or in the case of a cordless suction cleaner which is powered by batteries and consequently has a lower airflow compared with mains powered cleaners.

The present invention also relates to a vacuum cleaner incorporating a suction head as hereinbefore defined. The suction head of the vacuum cleaner may be provided with a handle for propelling the suction head by hand. In such a case, the suction head will generally be provided with suction-generating means, debris collecting means and optionally with a battery, such as a rechargeable battery.

For a better understanding of the present invention and to show more clearly how it may be carried into effect reference will now be made, by way of example, to the accompanying drawings in which:

DESCRIPTION OF PREFERRED EMBODIMENTS

Figure 1:
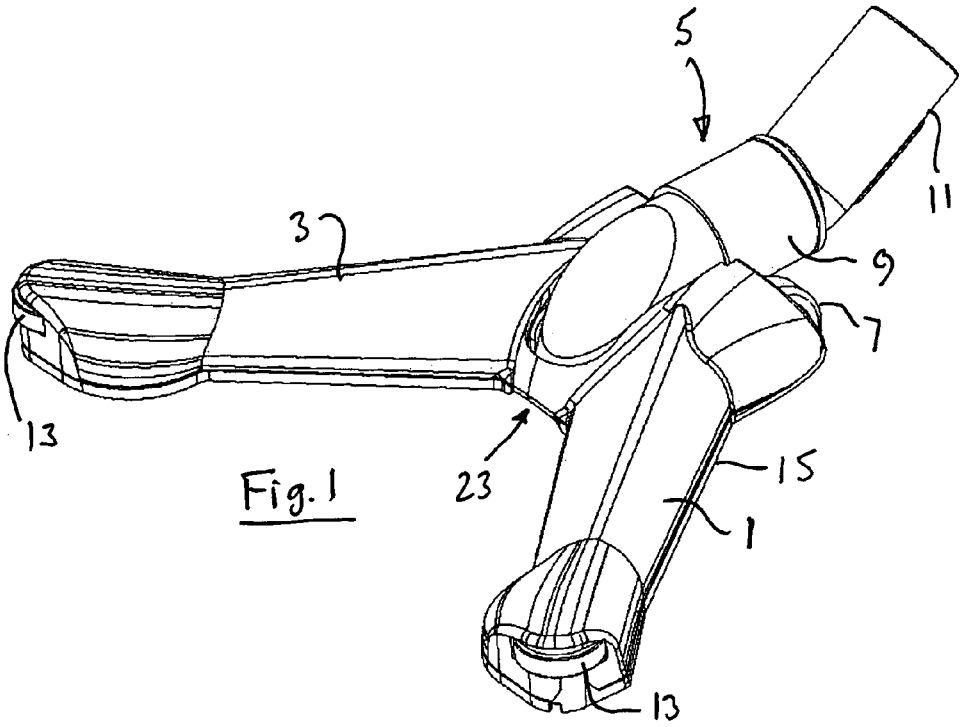
FIG. 1 is a perspective view from above of one embodiment of a suction head according to the present invention for a vacuum cleaner.
Figure 2:
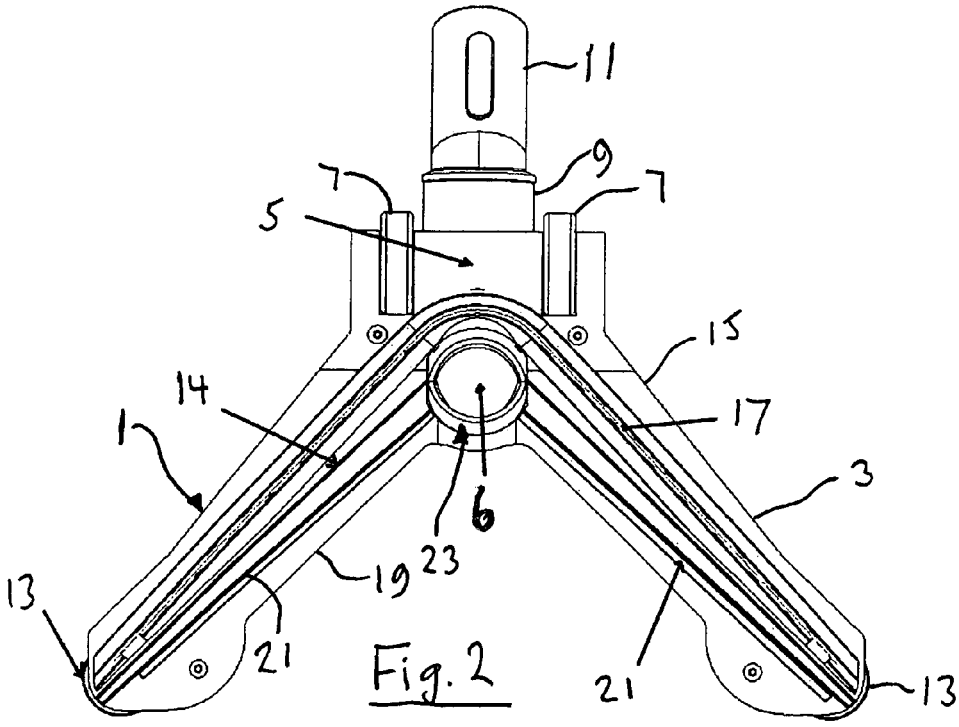
FIG. 2 is a plan view from below of the suction head shown in FIG. 1.
Figure 3:
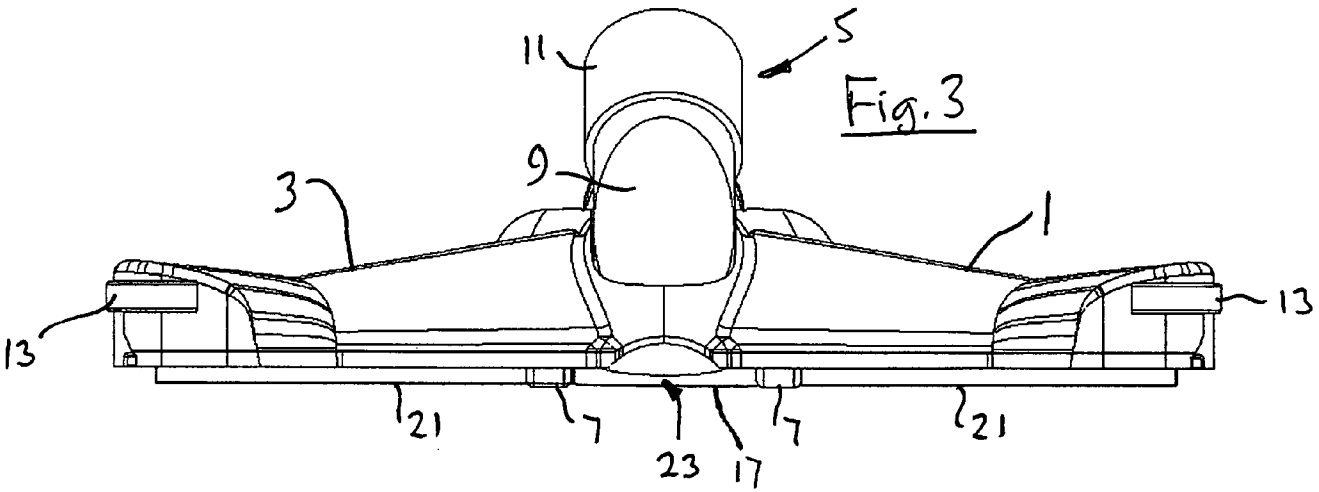
FIG. 3 is a front elevational view of the suction head shown in FIG. 1.
Figure 4:
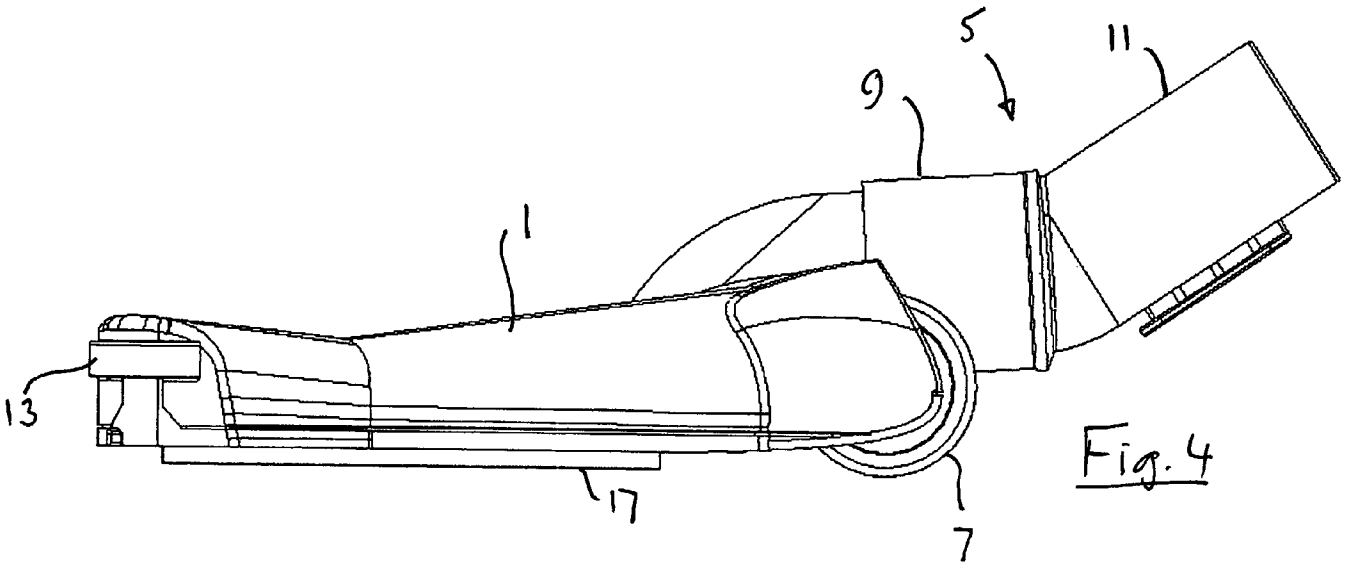
FIG. 4 is a side elevational view of the suction head shown in FIG. 1.

The vacuum cleaner suction head shown in the drawings includes a generally hollow domed body having two arms 1, 3 which diverge towards their free ends and are therefore arranged substantially in the shape of a V. That is, in contrast to conventional suction heads, the arms 1, 3 diverge at an angle less than 180 degrees.

Because the body of the suction head is hollow, in order to allow for the passage of air and debris drawn into the suction head, the lateral cross-sectional shape of each arm 1, 3 is generally in the form of an inverted U, although it will be appreciated that modifications of this shape can be employed.

In the region where the two arms 1 and 3 join, the suction head is provided with an outlet 5 for connection to a vacuum (suction) cleaner (not shown) and with a pair of freely rotatable wheels 7 for supporting the suction head, at least in part, during use. The wheels 7 are conveniently mounted one to each side of the outlet. The outlet 5 has an opening 6 into the interior of the suction head. The outlet itself is conveniently formed in two parts, a first part 9 which is secured to or formed integrally with the body of the suction head and a second part 11 which is rotatable relative to the first part about a longitudinal axis thereof. The second part 11 incorporates an angle in the longitudinal axis thereof such that rotation of the second part about its axis causes lateral movement in the suction head which can be used to steer the suction head. The outlet is connected to the remainder of the body of the suction head in a generally downwardly inclined direction.

The arms 1, 3 are provided at their free ends with rollers 13. The rollers are mounted so as to be freely rotatable about an upright axis and extend a short distance beyond the end of the respective arm so as to engage against a surface such as a wall, skirting or the like so as to roll along the surface without causing damage.

The cross-sectional area of the free space within the arms 1, 3 decreases progressively towards the free ends of the arms. This arrangement provides a relatively narrow channel 14, which is open at the free ends of the arms, for the passage of air and debris along each arm 1, 3 and allows the air speed within the channels to remain relatively constant along the length of the arms despite the fact that additional air continually enters as the flow path approaches the outlet 5. The channel 14 is particularly useful for removing particles of debris from crevices beneath the suction head and for cleaning adjacent to obstacles such as walls and items of furniture.

The region of the trailing (or outer) edge 15 of the body is provided with a continuous flexible (resilient) barrier 17 which extends from the free end of one of the arms, past the region of the outlet, to the free end of the other of the arms. The barrier engages with the ground as represented by a surface to be cleaned and is formed of a plurality of stiff resilient bristles which may allow the passage of a small amount of air therethrough, but substantially prevent the loss of any particles of debris. Bristles have the advantage that they can dislodge small particles of debris from within crevices beneath the suction head. As an alternative, the barrier 15 may be formed from a continuous strip of resilient material, for example an elastomeric material such as rubber.

The region of the leading (inner) edge 19 of the body is provided with two separate continuous flexible (resilient) barriers 21. Each barrier 21 extends from the free end of the respective arm towards the region of the outlet, but the barriers 21 are of a length such that there is a gap 23 between the ends of the barriers 21 in the region of the outlet 5 for the passage of larger particles of debris. The barriers 21 engage with the ground as represented by the surface to be cleaned and are each formed from a continuous strip of resilient material, for example an elastomeric material such as rubber. The continuous strip offers the advantage that it prevents the passage of undesired air through the barrier and into the channel 14, which could have the effect of reducing the overall speed of air within the channel 14. As an alternative, the barriers 21 may be formed from a plurality of resilient bristles which may allow the passage of a small amount of air therethrough.

If desired, the arrangement in the region of the trailing (or outer) edge can be similar to that in the region of the leading (or inner) edge in that two separate barriers may be provided with a gap between the barrier for the passage of larger particles of debris. In this way such larger particles of debris can be collected irrespective of whether the suction head is moving forwardly or rearwardly.

It should be noted that the arms 1 and 3 of the body of the suction head do not necessarily have to be arranged in the shape of a V. For example, the arms could be arranged in the shape of a U, or in any other configuration in which the two arms generally diverge so as, in use, to cause larger particles of debris to roll towards the region where the two arms join in order that such larger particles of debris can be drawn into the suction head through a single aperture in the leading edge of the suction head. Although not ideal, the arms may be incorporated into the body of the suction head. For example, the arms may be formed on a lower face of the body. Such an arrangement would still allow larger particles of debris to roll or be urged towards the gap 23, but the debris may not be visible to the user unless, for example, the body is made of a transparent of translucent material.

The vacuum cleaner may be mains powered or may be cordless, for example powered by rechargeable batteries.

In use of the vacuum cleaner suction head according to the present invention, the suction head is first connected to a vacuum cleaner (not shown) by way of a conventional elongate tubular handle and the vacuum cleaner is switched on so as to create a flow of air through the outlet 5 towards the vacuum cleaner itself. The handle of the vacuum cleaner can be used to move the suction head forwards and backwards and can additionally be twisted about its axis to rotate the head to the left or to the right. The combination of forwards and backwards movement, together with rotation of the suction head, allows the suction head to be steered with reasonable accuracy, for example to direct the head towards larger particles of debris. The rollers 13 at the free ends of the arms 1, 3 assist in regions where there are obstacles such as walls or pieces of furniture inasmuch as the rollers 13 can be urged against an obstacle to cause the suction head to turn and be steered. The rollers substantially prevent any damage to the obstacle itself because there is no need for sliding motion to occur between the rollers and the obstacle.

As the suction head is moved forwardly, small particles of debris pass beneath the barriers 21 or are drawn out of crevices below the suction head and are drawn by the flow of air, which passes beneath the barriers 21, along the elongate narrow channel 14 and through the outlet 5, and are carried to the vacuum cleaner. Larger particles of debris, which are unable to pass beneath the barriers 21, are urged or roll along the leading edge 19 of the suction head towards the region where the two arms 1 and 3 join until such time as the particles encounter the gap 23 between the two barriers 21 and can pass into the suction head and through the outlet to the vacuum cleaner. The combination of barriers 17 and 21, together with a single central gap 23 providing an opening for larger particles of debris, has been found to provide effective collection of such larger particles of debris while keeping the reduction of airflow due to the gap to a minimum.

It has been found that the suction head according to the present invention works particularly effectively when cleaning hard floors, even under conditions of reduced airflow such as often occur when a debris collection bag is almost full or a filter becomes blocked. The efficient use of airflow due to the barriers 17 and 21 results in the suction head being particularly effective with cordless, that is battery powered, appliances.

Figure 5:
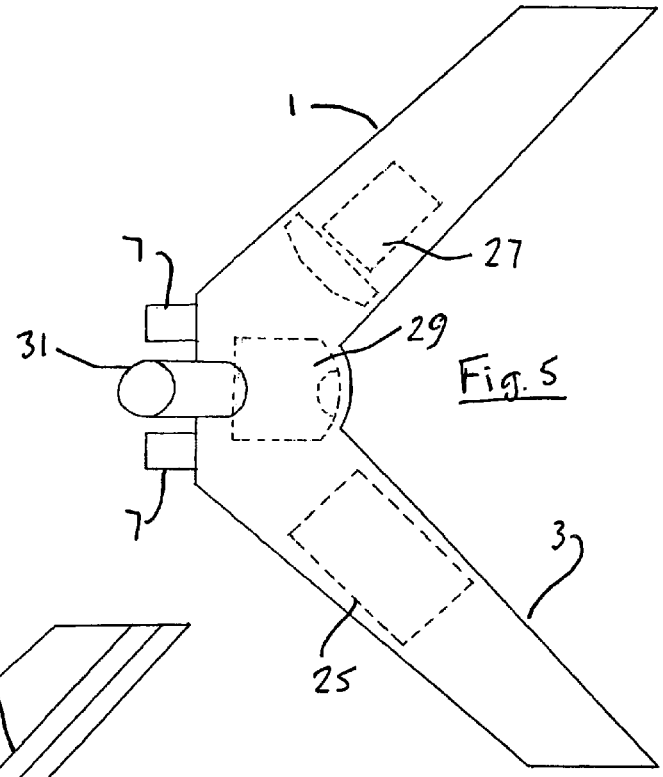
FIG. 5 is a diagrammatic view from above of an embodiment of the suction head shown in FIG. 1 incorporating a battery, suction and collection means.
Figure 6:
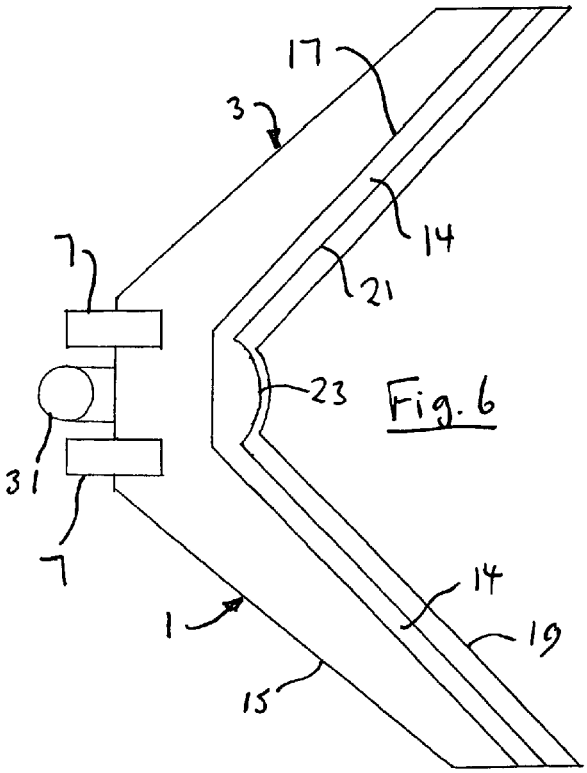
FIG. 6 is a diagrammatic view from below of the suction head shown in FIG. 5.

The suction head shown in FIGS. 5 and 6 is provided integrally therewith with a battery 25, suction means 27 and debris collection means 29, together with a handle 31 for propelling and steering the suction head. Although FIGS. 5 and 6 do not show rollers 13, such rollers may be provided if desired. The arrangement shown in FIGS. 5 and 6 provides a compact and efficient hand-operated vacuum cleaner.

I claim:

1. A suction inlet arrangement for a vacuum cleaner, the suction inlet arrangement comprising:

a body including a pair of arms which generally diverge in a forward direction from a predetermined region of the body at an angle of less than 180 degrees relative to each other, each arm defining therein a channel for the passage of air, which channel extends substantially from a free end of the arm to the region of the body from which the arms diverge, said channel being permanently open at the free end of the arm;

an outlet opening located in the region of the body from which the arms diverge;

a first ground-engaging barrier comprising a continuous strip extending along the region of a forward edge of one of the arms substantially from the free end of the arm to the region of the body from which the arms diverge;

a second ground-engaging barrier comprising a continuous strip extending along the region of a forward edge of the other of the arms substantially from the free end of the arm to the region of the body from which the arms diverge, adjacent ends of the first and second barriers being spaced from one another to form a permanently open gap in the region of the body from which the arms diverge, for the passage of relatively large particles of debris into the suction inlet arrangement, the first and second barriers being adapted to engage a substantially flat ground surface along their entire lengths; three permanently open air passageways for air flow to the outlet opening thereby being defined, a first air passageway along the channel in one of the arms from the permanently open end of that channel, a second air passageway along the channel in the other of the arms from the permanently open end of that channel, and a third air passageway through the permanently open gap between the first and second barriers; and means for propelling the suction inlet arrangement, the propelling means being mounted in a rear portion of the region of the body from which the arms diverge such that, when the suction inlet arrangement is moved forwardly, relatively large particles of debris are urged or roll along the forward edges of the arms towards the permanently open gap formed between the first and second barriers.

2. A suction inlet arrangement as claimed in claim 1, wherein a substantially continuous further ground-engaging barrier extends along the region of a rear edge of the arms substantially from the free end of the one of the arms to the free end of the other of the arms.

3. A suction inlet arrangement as claimed in claim 2, wherein the barrier in the region of the rear edge of the arms comprise a plurality of stiff resilient bristles.

4. A suction inlet arrangement as claimed in claim 1, wherein a first substantially continuous further ground-engaging barrier extends along the region of a rear edge of the one of the arms substantially from the free end of the arm to the region of the body from which the arms diverge and a second substantially continuous further ground-engaging barrier extends along the region of a rear edge of the other of the arms substantially from the free end of the arm to the region of the body from which the arms diverge, there being a further gap between the first and second further barriers in the region of the body from which the arms diverge for the passage of relatively large particles of debris into the suction inlet arrangement.

5. A suction inlet arrangement as claimed in claim 1, wherein the arms diverge in a shape selected from a V-shape and a U-shape.

6. A suction inlet arrangement as claimed in claim 1, wherein the body is provided with one or more wheels for supporting the body relative to the ground.

7. A suction inlet arrangement as claimed in claim 6, wherein one wheel is provided each side of the outlet opening.

8. A suction inlet arrangement as claimed in claim 1 and including an outlet connection including a first tubular member secured to or formed integrally with the body and a second tubular member rotatable about the axis thereof relative to the first tubular member.

9. A suction inlet arrangement as claimed in claim 8, wherein the axis of the second tubular member incorporates an angle along the length thereof.

10. A suction inlet arrangement as claimed in claim 1, wherein rotatable means is provided substantially at the free end of each arm for engaging with obstacles.

11. A suction inlet arrangement as claimed in claim 10, wherein the rotatable means is in the form of a roller which is rotatable about a substantially upright axis.

12. A suction inlet arrangement as claimed in claim 1, wherein the cross-sectional area of the channel decreases towards the free end of each arm.

13. A suction inlet arrangement as claimed in claim 1, wherein the barriers are flexible.

14. A suction inlet arrangement as claimed in claim 13, wherein the barriers are resilient.

15. A suction inlet arrangement as claimed in claim 13, wherein one or more of the barriers comprises a plurality of stiff resilient bristles.

16. A suction inlet arrangement as claimed in claim 1, wherein the continuous strips are elastomeric.

17. A suction inlet arrangement as claimed in claim 16, wherein the continuous strips are made of rubber.

18. A vacuum cleaner incorporating a suction inlet arrangement as claimed in claim 1.

19. A vacuum cleaner as claimed in claim 18, wherein the suction inlet arrangement is provided with a handle for propelling the vacuum cleaner by hand.

20. A vacuum cleaner as claimed in claim 19 and including in the suction arrangement suction-generating means and debris collecting means.

21. A vacuum cleaner as claimed in claim 20, further including a battery in the suction inlet arrangement.

22. A vacuum cleaner as claimed in claim 21, wherein the battery is rechargeable.

* * * * *